US008436785B1

(12) United States Patent
Lai et al.

(10) Patent No.: US 8,436,785 B1
(45) Date of Patent: May 7, 2013

(54) ELECTRICALLY TUNABLE SURFACE IMPEDANCE STRUCTURE WITH SUPPRESSED BACKWARD WAVE

(75) Inventors: Anthony Lai, Los Angeles, CA (US); Joseph S. Colburn, Malibu, CA (US)

(73) Assignee: HRL Laboratories, LLC, Malibu, CA (US)

( * ) Notice: Subject to any disclaimer, the term of this patent is extended or adjusted under 35 U.S.C. 154(b) by 373 days.

(21) Appl. No.: 12/939,040

(22) Filed: Nov. 3, 2010

(51) Int. Cl.
*H01Q 15/02* (2006.01)
*H01Q 9/00* (2006.01)

(52) U.S. Cl.
USPC ..... 343/909; 343/745; 343/754

(58) Field of Classification Search ..... 343/909, 343/913, 754, 745, 700 MS
See application file for complete search history.

(56) References Cited

U.S. PATENT DOCUMENTS

| | | | | |
|---|---|---|---|---|
| 3,267,480 | A | 8/1966 | Lerner | 343/911 |
| 3,560,978 | A | 2/1971 | Himmel et al. | 342/399 |
| 3,810,183 | A | 5/1974 | Krutsinger et al. | 343/708 |
| 3,961,333 | A | 6/1976 | Purinton | 343/872 |
| 4,045,800 | A | 8/1977 | Tang et al. | 342/372 |
| 4,051,477 | A | 9/1977 | Murphy et al. | 343/700 |
| 4,119,972 | A | 10/1978 | Fletcher et al. | 343/844 |
| 4,123,759 | A | 10/1978 | Hines et al. | 343/854 |
| 4,124,852 | A | 11/1978 | Steudel | 342/374 |
| 4,127,586 | A | 11/1978 | Rody et al. | 548/260 |
| 4,150,382 | A | 4/1979 | King | 343/754 |
| 4,173,759 | A | 11/1979 | Bakhru | 342/382 |
| 4,189,733 | A | 2/1980 | Malm | 342/368 |
| 4,217,587 | A | 8/1980 | Jacomini | 342/372 |
| 4,220,954 | A | 9/1980 | Marchand | 342/433 |
| 4,236,158 | A | 11/1980 | Daniel | 342/380 |
| 4,242,685 | A | 12/1980 | Sanford | 343/770 |
| 4,266,203 | A | 5/1981 | Saudreau et al. | 333/21 |
| 4,308,541 | A | 12/1981 | Frosch et al. | 343/786 |
| 4,367,475 | A | 1/1983 | Schiavone | 343/767 |
| 4,370,659 | A | 1/1983 | Chu et al. | 343/772 |
| 4,387,377 | A | 6/1983 | Kandler | 343/756 |
| 4,395,713 | A | 7/1983 | Nelson et al. | 343/713 |
| 4,443,802 | A | 4/1984 | Mayes | 343/729 |
| 4,590,478 | A | 5/1986 | Powers et al. | 343/700 |
| 4,594,595 | A | 6/1986 | Struckman | 343/770 |
| 4,672,386 | A | 6/1987 | Wood | 343/770 |
| 4,684,953 | A | 8/1987 | Hall | 343/725 |
| 4,700,197 | A | 10/1987 | Milne | 343/837 |
| 4,737,795 | A | 4/1988 | Nagy et al. | 343/712 |
| 4,749,996 | A | 6/1988 | Tresselt | 343/700 |
| 4,760,402 | A | 7/1988 | Mizuno et al. | 343/713 |
| 4,782,346 | A | 11/1988 | Sharma | 343/795 |
| 4,803,494 | A | 2/1989 | Norris et al. | 343/770 |

(Continued)

*Primary Examiner* — Hoang V Nguyen
(74) *Attorney, Agent, or Firm* — Ladas & Parry

(57) ABSTRACT

A method of delaying the onset of a backward wave mode in a frequency selective surface having a two dimensional array of conductive patches or elements and an RF ground plane, the two dimensional array of patches or elements being interconnected by variable capacitors, the method comprising separating grounds associated with the variable capacitors from the RF ground plane and providing a separate conductive mesh structure or arrangement as a bias voltage ground for the variable capacitors. A tunable impedance surface comprises a RF ground plane; a plurality of patches or elements disposed in an array a distance from the ground plane; a capacitor arrangement for controllably varying capacitance between at least selected ones of adjacent patches or elements in the array; and a grounding mesh associated with the capacitor arrangement for providing a control voltage ground to capacitors in the capacitor arrangement, the grounding mesh being spaced from the RF ground plane by dielectric material.

17 Claims, 6 Drawing Sheets

U.S. PATENT DOCUMENTS 4,821,040 A 4/1989 Johnson et al. 343/700
4,835,541 A 5/1989 Johnson et al. 343/713
4,843,400 A 6/1989 Tsao et al. 343/700
4,843,403 A 6/1989 Lalezari et al. 343/767
4,853,704 A 8/1989 Diaz et al. 343/767
4,903,033 A 2/1990 Tsao et al. 343/700
4,905,014 A 2/1990 Gonzalez et al. 343/90
4,916,457 A 4/1990 Foy et al. 343/770
4,922,263 A 5/1990 Dubost et al. 343/797
4,958,165 A 9/1990 Axford et al. 343/770
5,021,795 A 6/1991 Masiulis 343/700
5,023,623 A 6/1991 Kreinheder et al. 343/725
5,070,340 A 12/1991 Diaz 343/767
5,081,466 A 1/1992 Bitter, Jr. 343/767
5,115,217 A 5/1992 McGrath et al. 333/246
5,146,235 A 9/1992 Frese 343/895
5,158,611 A 10/1992 Ura et al. 106/499
5,208,603 A 5/1993 Yee 343/909
5,235,343 A 8/1993 Audren et al. 343/816
5,268,696 A 12/1993 Buck et al. 342/372
5,268,701 A 12/1993 Smith 343/767
5,278,562 A 1/1994 Martin et al. 342/1
5,287,116 A 2/1994 Iwasaki et al. 343/700
5,287,118 A 2/1994 Budd 343/909
5,402,134 A 3/1995 Miller et al. 343/742
5,406,292 A 4/1995 Schnetzer et al. 343/700
5,519,408 A 5/1996 Schnetzer 343/767
5,525,954 A 6/1996 Komazaki et al. 333/219
5,531,018 A 7/1996 Saia et al. 29/622
5,532,709 A 7/1996 Talty 343/819
5,534,877 A 7/1996 Sorbello et al. 343/700
5,541,614 A 7/1996 Lam et al. 343/792.5
5,557,291 A 9/1996 Chu et al. 343/725
5,581,266 A 12/1996 Peng et al. 343/770
5,589,845 A 12/1996 Yandrofski et al. 343/909
5,600,325 A 2/1997 Whelan et al. 342/13
5,611,940 A 3/1997 Zettler 73/514.16
5,619,366 A 4/1997 Rhoads et al. 359/248
5,621,571 A 4/1997 Bantli et al. 359/529
5,638,946 A 6/1997 Zavracky 200/181
5,644,319 A 7/1997 Chen et al. 343/702
5,694,134 A 12/1997 Barnes 343/700
5,721,194 A 2/1998 Yandrofski et al. 505/210
5,767,807 A 6/1998 Pritchett 342/374
5,808,527 A 9/1998 De Los Santos 333/205
5,874,915 A 2/1999 Lee et al. 342/375
5,892,485 A 4/1999 Glabe et al. 343/789
5,894,288 A 4/1999 Lee et al. 343/770
5,905,465 A 5/1999 Olson et al. 343/700
5,923,303 A 7/1999 Schwengler et al. 343/853
5,926,139 A 7/1999 Korisch 343/702
5,929,819 A 7/1999 Grinberg 343/754
5,943,016 A 8/1999 Snyder, Jr. et al. 343/700
5,945,951 A 8/1999 Monte et al. 343/700
5,949,382 A 9/1999 Quan 343/767
5,966,096 A 10/1999 Brachat 343/700
5,966,101 A 10/1999 Haub et al. 343/767
6,005,519 A 12/1999 Burns 343/700
6,005,521 A 12/1999 Suguro et al. 343/700
6,008,770 A 12/1999 Sugawara 343/767
6,016,125 A 1/2000 Johansson 343/702
6,028,561 A 2/2000 Takei 343/767
6,028,692 A 2/2000 Rhoads et al. 359/245
6,034,644 A 3/2000 Okabe et al. 343/767
6,034,655 A 3/2000 You 345/60
6,037,905 A 3/2000 Koscica et al. 333/701
6,040,803 A 3/2000 Spall 343/700
6,046,655 A 4/2000 Cipolla 333/137
6,046,659 A 4/2000 Loo et al. 333/262
6,054,659 A 4/2000 Lee et al. 200/181
6,061,025 A 5/2000 Jackson et al. 343/700
6,075,485 A 6/2000 Lilly et al. 343/700
6,081,235 A 6/2000 Romanofsky et al. 343/700
6,081,239 A 6/2000 Sabet et al. 343/753
6,097,263 A 8/2000 Mueller et al. 333/17.1
6,097,343 A 8/2000 Goetz et al. 343/708
6,118,406 A 9/2000 Josypenko 343/700
6,118,410 A 9/2000 Nagy 343/713
6,127,908 A 10/2000 Bozler et al. 333/246
6,150,989 A 11/2000 Aubry 343/767
6,154,176 A 11/2000 Fathy et al. 343/700
6,166,705 A 12/2000 Mast et al. 343/853
6,175,337 B1 1/2001 Jasper, Jr. et al. 343/770
6,175,723 B1 1/2001 Rothwell, III 455/63.1
6,188,369 B1 2/2001 Okabe et al. 343/767
6,191,724 B1 2/2001 McEwan 342/21
6,198,438 B1 3/2001 Herd et al. 343/700
6,198,441 B1 3/2001 Okabe et al. 343/702
6,204,819 B1 3/2001 Hayes et al. 343/702
6,218,912 B1 4/2001 Mayer 333/106
6,218,997 B1 4/2001 Lindenmeier et al. 343/725
6,246,377 B1 6/2001 Aiello et al. 343/770
6,252,473 B1 6/2001 Ando 333/105
6,285,325 B1 9/2001 Nalbandian et al. 343/700
6,307,519 B1 10/2001 Livingston et al. 343/767
6,317,095 B1 11/2001 Teshirogi et al. 343/785
6,323,826 B1 11/2001 Sievenpiper et al. 343/909
6,331,257 B1 12/2001 Loo et al. 216/13
6,337,668 B1 1/2002 Ito et al. 343/833
6,366,254 B1 4/2002 Sievenpiper et al. 343/770
6,373,349 B2 4/2002 Gilbert 333/126
6,380,895 B1 4/2002 Moren et al. 343/700
6,388,631 B1 5/2002 Livingston et al. 343/767
6,392,610 B1 5/2002 Braun et al. 343/876
6,404,390 B2 6/2002 Sheen 343/700
6,404,401 B2 6/2002 Gilbert et al. 343/780
6,407,719 B1 6/2002 Ohira et al. 343/893
6,417,807 B1 7/2002 Hsu et al. 343/700
6,424,319 B2 7/2002 Ebling et al. 343/911
6,426,722 B1 7/2002 Sievenpiper et al. 343/700
6,440,767 B1 8/2002 Loo et al. 438/52
6,469,673 B2 10/2002 Kaiponen 343/703
6,473,362 B1 10/2002 Gabbay 367/119
6,483,480 B1 11/2002 Sievenpiper et al. 349/909
6,496,155 B1 12/2002 Sievenpiper et al. 343/770
6,515,635 B2 2/2003 Chiang et al. 343/834
6,518,931 B1 2/2003 Sievenpiper 343/770
6,525,695 B2 2/2003 McKinzie, III 343/756
6,538,621 B1 3/2003 Sievenpiper et al. 343/909
6,552,696 B1 4/2003 Sievenpiper et al. 343/909
6,624,720 B1 9/2003 Allison et al. 333/105
6,642,889 B1 11/2003 McGrath 343/700
6,657,525 B1 12/2003 Dickens et al. 335/78
6,864,848 B2 3/2005 Sievenpiper 343/767
6,897,810 B2 5/2005 Dai et al. 343/700
6,940,363 B2 9/2005 Zipper et al. 333/103
7,068,234 B2 6/2006 Sievenpiper 343/745
7,164,387 B2 1/2007 Sievenpiper 343/702
7,245,269 B2 7/2007 Sievenpiper et al. 343/909
7,253,699 B2 8/2007 Schaffner et al. 333/32
7,253,780 B2 * 8/2007 Sievenpiper 343/745
7,276,990 B2 10/2007 Sievenpiper 333/101
7,298,228 B2 11/2007 Sievenpiper 333/101
7,911,386 B1 * 3/2011 Itoh et al. 343/700 MS
8,212,739 B2 * 7/2012 Sievenpiper 343/909
2002/0036586 A1 3/2002 Gothard et al. 342/374
2003/0193446 A1 10/2003 Chen 343/893
2003/0222738 A1 12/2003 Brown et al. 333/206
2004/0227668 A1 11/2004 Sievenpiper 343/700

* cited by examiner

ELECTRICALLY TUNABLE SURFACE IMPEDANCE STRUCTURE WITH SUPPRESSED BACKWARD WAVE

CROSS REFERENCE TO RELATED APPLICATIONS

This application is related to the disclosure of U.S. patent application Ser. No. 10/537,923 filed Mar. 29, 2000 (now U.S. Pat. No. 6,538,621, issued Mar. 25, 2003) and of U.S. patent application Ser. No. 10/792,411 filed Mar. 2, 2004 (now U.S. Pat. No. 7,068,234, issued Jun. 27, 2006), the disclosures of which are hereby incorporated herein by reference.

TECHNICAL FIELD

This invention relates to an electrically tunable surface impedance structure with a suppressed backward wave. Surface impedance structures are a tunable electrically tunable surface impedance structure is taught by U.S. Pat. Nos. 6,538,621 and 7,068,234. This disclosure relates to a technique for reducing the propensity of the structures taught by U.S. Pat. Nos. 6,538,621 and 7,068,234 to generate a backward wave.

BACKGROUND

FIG. 1*a* depicts a conceptual view of a frequency selective surface 20 without varactor diodes (which varactor diodes or other variable capacitance devices can be used to realize an electrically steerable surface wave antenna—see FIG. 2*a*). The surface 20 of FIG. 1*a* comprises a plane of periodic metal patches 22 separated from a ground plane 26 by a dielectric layer 21 (not shown in FIG. 1*b*, but see, for example, FIGS. 2*a* and 2*b*). An antenna (not shown) is typically mounted directly on the frequency selective surface 20. See, e.g., U.S. Pat. No. 7,068,234 issued Jun. 27, 2006. The thickness of the dielectric layer 26 can be less than 0.1 of a wavelength of operational frequency of the non-shown antenna. This surface 20 supports a fundamental TM surface wave as shown in its dispersion diagram (frequency vs. propagation constant) of FIG. 1*b*. The surface impedance of any TM surface wave structure can be calculated by using:

$$Z_{TM}=jZ_o\{(\beta/k_o)^2-1\}$$

where $Z_o$ is characteristic impedance of free space, $k_o$ is the free space wavenumber and $\beta$ is the propagation constant of the mode.

FIG. 1*a* depicts the basic structure that supports a fundamental TM surface wave mode. A dielectric substrate 21 (see FIGS. 2*a* and 2*b*, not shown in FIG. 1*a* for ease of illustration) between the plane of metallic patches 22 and the ground plane 26 provides structural support and is also a parameter that determines the dispersion of the structure. This structure can be made using printed circuit board technology, with a 2-D array of metallic patches 26 formed on one major surface of the printed circuit board and a metallic ground plane 26 formed on an opposing major surface of the printed circuits board, with the dielectric of the printed circuit board providing structural support. The equivalent circuit model of the structure is superimposed over the physical elements of FIG. 1*a*: a series inductance ($L_R$) is due to current flow on the patch 22, a shunt capacitance ($C_R$) is due to voltage potential from patch 22 to ground plane 26, and a series capacitance ($C_L$) is due to fringing fields between the gaps between the patches 22. The dispersion diagram of FIG. 1*b* shows that a fundamental TM forward wave mode (since the slope is positive) is supported.

In order to control the dispersion and thus the surface impedance at a fixed frequency of the surface shown in FIG. 1*a*, the gap capacitance (between neighboring metal patches 22) can be electrically controlled by the use of varactor diodes 30. The varactor diodes 30 are disposed in the gap between each patch 22 and are connected to neighboring patches 22 as shown in FIG. 2*a*. However, since a DC bias is required in order to control the capacitance of the varactor diodes 30, the structure of FIG. 1*a* has been modified to include not only varactor diodes 30 but also a biasing network supplying biasing voltages $V_1, V_2, \ldots V_n$. FIG. 2*b* shows a cross-sectional view of the structure of FIG. 2*a* with varactor diodes and the aforementioned biasing network; every other patch is connected directly to the ground plane 26 by conductive grounding vias 24 and the remaining patches are connected to the biasing voltage network by conductive bias vias 28. See, for example, U.S. Pat. Nos. 6,538,621 and 7,068,234 for additional information.

However, the addition of the bias vias 28 penetrating the ground plane 26 at penetrations 32 introduces a shunt inductance to the equivalent circuit model superimposed in FIG. 1*a*. FIG. 3*a* depicts a model similar to that of FIG. 1*a*, but showing the effect of introducing the bias network of FIGS. 2*a* and 2*b* by a shunt inductance $L_L$. As shown by FIG. 3*b*, TM backward wave is supported when a series capacitance and a shunt inductance are present, the latter of which is contributed by the bias via 28. The backward wave decreases the frequency/impedance range of the surface wave structure since one can couple to only a forward wave or to a backward wave at a given frequency.

It would be desirable to allow for control of the dispersion and thus the surface impedance of the frequency selective surface of FIG. 1*a* by using variable capacitors (such as, for example, varactor diodes) as taught by Sievenpiper (see, for example, U.S. Pat. No. 7,068,234) and in FIGS. 2*a* and 2*b* hereof, but without the introduction of a backward wave.

BRIEF DESCRIPTION OF THE INVENTION

In one aspect the present invention provides a method of delaying the onset of a backward wave mode in a frequency selective surface having a two dimensional array of conductive patches and an RF ground plane, the two dimensional array of patches being interconnected by variable capacitors, the method including separating grounds associated with the variable capacitors from the RF ground plane and providing a separate conductive mesh structure as a control voltage ground for the variable capacitors.

In another aspect the present invention provides a tunable impedance surface having: (a) a RF ground plane; (b) a plurality of elements disposed in an array a distance from the ground plane; (c) a capacitor arrangement for controllably varying capacitance between at least selected ones of adjacent elements in said array; and (d) a grounding mesh associated with said capacitor arrangement for providing a control voltage ground to capacitors in said capacitor arrangement, the grounding mesh being spaced from the RF ground plane by a dielectric.

In yet another aspect the present invention provides a method of tuning a high impedance surface for reflecting a radio frequency signal comprising: arranging a plurality of generally spaced-apart conductive surfaces in an array disposed essentially parallel to and spaced from a conductive RF ground plane and varying the capacitance between at least selected ones of adjacent conductive surfaces in to thereby tune the impedance of said high impedance surface using control voltages, the control voltages being referenced to a control voltage ground supplied via a grounding mesh which is isolated from said RF ground plane by a layer of dielectric material.

In still yet another aspect the present invention provides a tunable impedance surface for reflecting a radio frequency beam, the tunable surface comprising: (a) a ground plane; (b) a plurality of elements disposed in an array a distance from the ground plane, the distance being less than a wavelength of the radio frequency beam; (c) a capacitor arrangement for controllably varying the impedance along said array; and (d) means for suppressing a formation of a backward wave by said tunable impedance surface.

In another aspect the present invention provides a tunable impedance surface comprising: (a) a ground plane; (b) a plurality of discreet elements disposed in a two-dimensional array a distance from the ground plane; and (c) a plurality of capacitors coupling neighboring ones of the elements in said two dimensional array for controllably varying capacitive coupling between the neighboring ones of said elements in said two-dimensional array while at the same time suppressing a formation of a backward wave by the tunable impedance surface.

DETAILED DESCRIPTION

This invention prevents a backward wave mode from occurring in a frequency selective surface while allowing for biasing of the varactor diodes used to control the dispersion and thus the surface impedance of the frequency selective surface at a fixed frequency. This improved frequency selective surface is realized by separating a RF ground plane from the bias network ground.

Figure 4A:
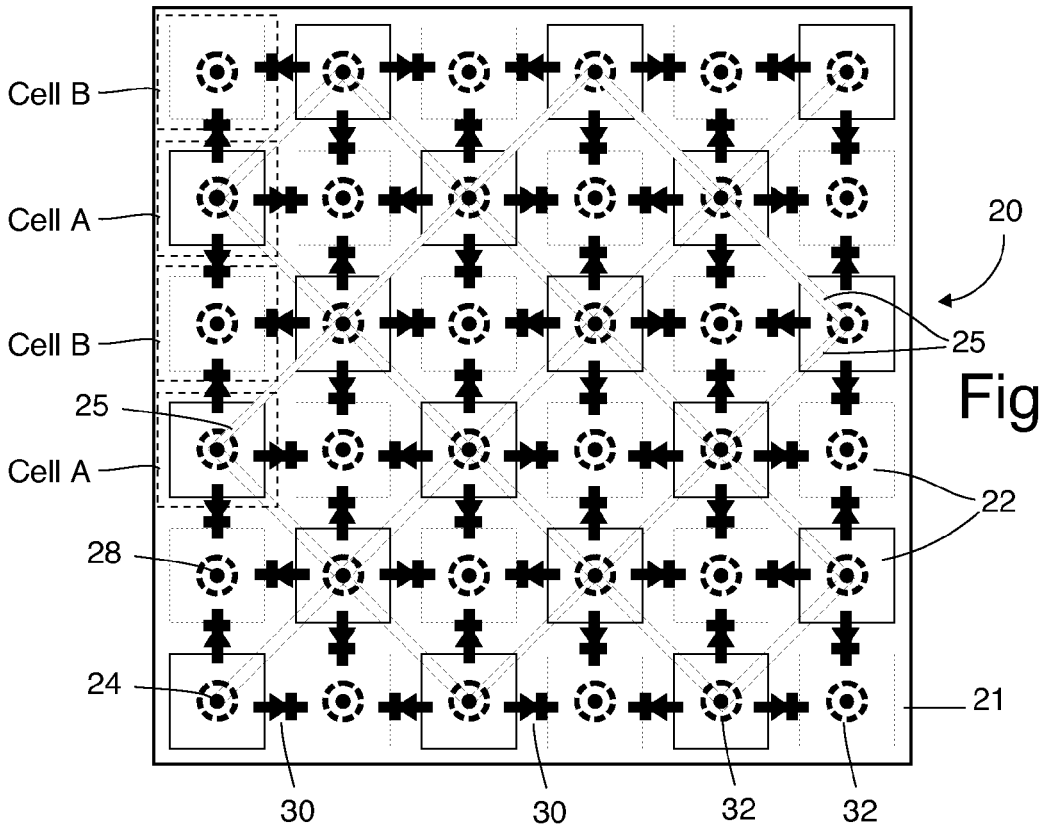
FIGS. 4*a* and 4*b* are plan and side elevational views of an embodiment of a frequency selective surface with variable capacitors to control surface impedance of the surface and a RF ground plane which is separated from a ground mesh used with the variable capacitors.
Figure 4B:
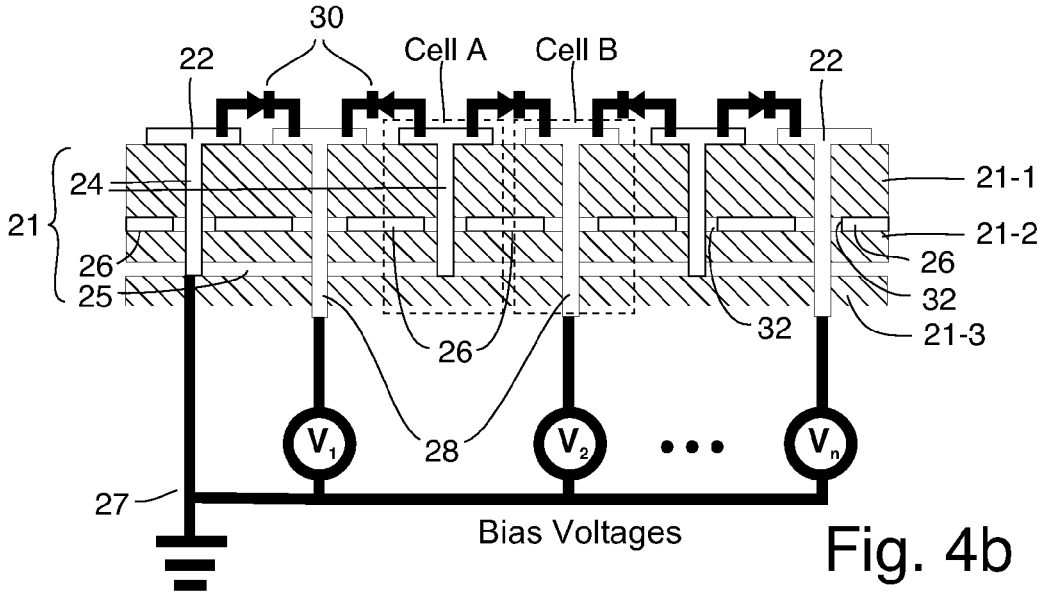

FIGS. 4*a* and 4*b* show that the RF ground plane 26 has been separated from an open mesh-like arrangement 25 of conductors connecting the bias grounding vias 24 to a common potential. Note that the ground plane 26 is located above the mesh-like arrangement 25 of conductors in FIG. 4*b* so that from a radio frequency perspective, the ground plane 26 serves as a RF ground for the conductive patches or elements 22 without undue interference from their associated conductive control vias 24, 28 which penetrate the ground plane 26 at penetrations 32. The conductive control vias 24 are connected to the common potential (bias voltage ground 27) associated with the biasing voltages $V_1, V_2, \ldots V_n$, via the conductive mesh 25 while conductive vias 28 are connected to the biasing voltages $V_1, V_2, \ldots V_n$ themselves. So the bias voltage ground 27 is separated from the RF ground 26.

The substrate 21 is preferably formed as a multi-layer substrate with, for example, three layers 21-1, 21-2, and 21-3 of dielectric material (as such, for example, a multi-layer printed circuit board). The conductive patches or elements 22 are preferably formed by metal patches or elements disposed on layer 21-1 of a multi-layer printed circuit board.

The bias ground network or mesh 25 preferably takes the form of a meshed structure, in which the connection lines 25 are disposed diagonally, in plan view, with respect to the conductive patches or elements 22 as shown in FIG. 4*a*. Relatively thin wires 25 are preferably used in the meshed bias network to provide a high impedance at RF frequencies of interest and are preferably printed between layers 21-2 and 21-3 of the multi-layer printed circuit board. Penetration 32 is designed to be small enough to provide a suitable RF ground at the RF frequencies of interest but large enough to avoid contacting conductive vias 24 and 28—in other words, the penetrations 32 should appear as essentially a short circuit at the RF frequencies of interest and as essentially an open circuit at the switching frequencies of the bias voltages $V_1$, $V_2, \ldots V_n$. The RF return current follows the path of least impedance which, in the present invention, is provided by the RF ground plane 26 which is preferably formed as a layer of a conductor, such a copper, with openings 32 formed therein. When a surface wave is excited on the plane of the conductive patches or elements 22, some of the energy is guided between the bias voltage ground mesh 25 and the RF ground plane 26. Since the grounding vias 24 are not connected to the RF ground plane 26 (as done in the prior art), but rather to the bias ground network or mesh 25, no shunt inductance is observed by the propagating wave. As a result, a backward wave mode cannot exist since a shunt inductance is no longer present.

The bias ground network 25 need not necessarily assume the meshed structure shown in FIG. 4*a* as other arrangements of the wires making up the meshed structure will likely prove to be satisfactory in presenting a suitably high impedance at the RF frequencies of interest so that the RF frequencies of interest will not treat the bias ground network 25 as an RF ground. As the bias ground network 25 begins to appear more like an RF ground, the less effective the present invention is in suppressing the backward wave. So ideally the bias ground network 25 should have as high an impedance as possible at the RF frequencies of interest consistent with the need to provide a bias ground 27 for the bias voltages $V_1, V_2, \ldots V_n$ (which are at or near DC compared to the RF references of interest). The bias ground network 25 is depicted as being located below the RF ground plane 26 so that it is further from the array of conductive patches or elements 22 than is the RF ground plane 26. This location is believed to be preferable compared to switching the positions RF ground plane 26 and the bias ground network 25; but if the bias ground network 25 has a suitably high impedance at the RF frequencies of interest, it may function suitably even if it is located closer to the array of conductive patches or elements 22 than is the RF ground plane 26. Testing and/or simulation should be able to verify whether or not this is correct.

The term "wires" which make up the meshed structure of the bias ground network 25 is used without implication as to shape or material. While the wires are preferably provided by electrically conductive strips disposed on a printed circuit board, they might alternatively individual wires, they might be round or flat, coiled or straight and they might be formed by conductive regions on or in a semiconductor substrate.

The patch plane comprises a 2-D array of conductive patches or elements 22 of a type A cell (Cell A) and a type B cell (Cell B) forms; a type A cell is connected to the bias ground network 25 while a type B cell is connected to a separate bias voltage network of voltages $V_1, V_2, \ldots V_n$. Only two cells are marked with dashed lines designating the cell types for ease of illustration in FIG. 4*b*, but they preferably repeat in a checkerboard fashion. A cell includes its patch/element 22, its associated portion of the RF ground plane 26, and its associated control electrode or via (via 24 for a type A cell or via 28 for a type B cell). As can be seen from FIGS. 4*a* and 4*b*, generally speaking the immediate neighbors of a type A cell are four type B cells and the immediate neighbors of a type B cell are four type A cells.

While the 2-D array of conductive patches or elements 22 are depicted as patches or elements of a square configuration, it should be appreciated that the individual patches or elements need not be square or as other geometric configurations can be employed if desired. See, for example, U.S. Pat. No. 6,538,621, issued Mar. 25, 2003, which is incorporated by reference herein, for other geometric configurations.

Dielectric layer 21-1 separates the conductive patches or elements 22 from the RF ground plane 26 and preferably provides structural support for surface 20. In addition, size and dielectric nature of the dielectric layer 21-1 is a parameter that dictates the RF properties of the structure 20. RF ground plane 26 provides a return path for the RF current; holes 32 are introduced in the RF ground plane 26 to allow the via 24 of Cell A type cells to connect to the meshed DC ground plane 25 and to allow the via 28 Cell B type cells to connect to the bias voltage network.

Dielectric layer 21-2 preferably acts a support structure for the bias ground network or mesh 25 and the bias voltage network. An optional dielectric layer 21-3 can be added beneath dielectric layer 21-1 and mesh 25 to provide additional power and/or signal connections for vias 28. Dielectric layers 21-1, 21-2 and 21-3 can each consist of multiple dielectric substrates sandwiched together, if desired.

The mesh DC ground plane 25 preferably comprises diagonal cross connections which are made up of thin metal traces for presenting high impedance from a RF standpoint. The via 24 of Cell A connects directly to the mesh DC ground plane 25. The ground plane 25 can likely take other forms than a mesh like structure, but the mesh structure shown in FIG. 4*a* is believed to yield a structure which is easy to manufacture and which will present a high impedance to the surface at RF frequencies of interest. The bias voltage network 25 connects to the conductive vias 28 of Cells B.

Figure 1A:
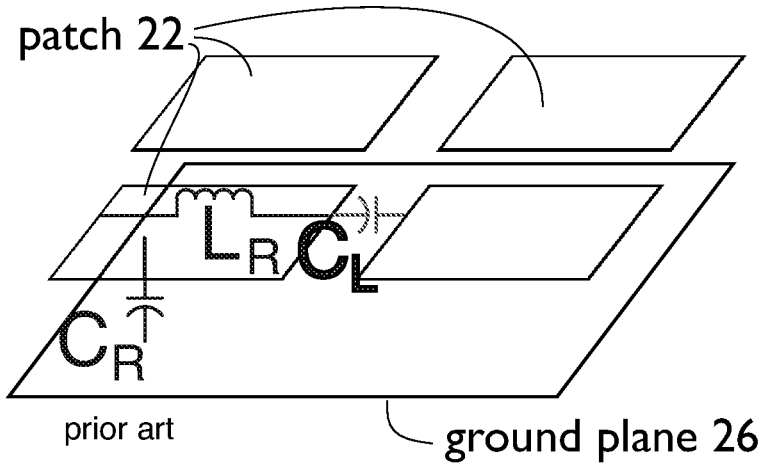
FIG. 1*a* depicts a perspective view of a prior art frequency selective surface consisting of a plane of periodic metal patches or elements separated from a ground plane by a dielectric layer.
Figure 1B:
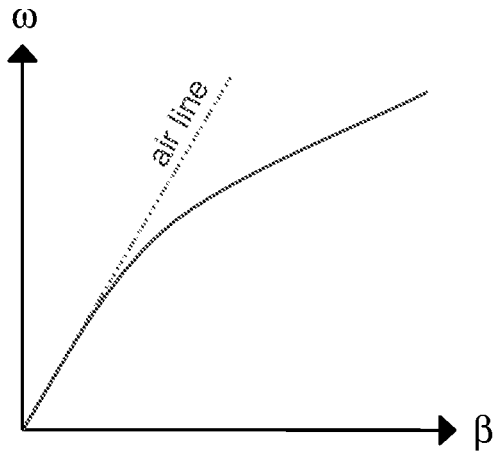
FIG. 1*b* is a graph of frequency vs. propagation constant for the surface of FIG. 1*a;*
Figure 2A:
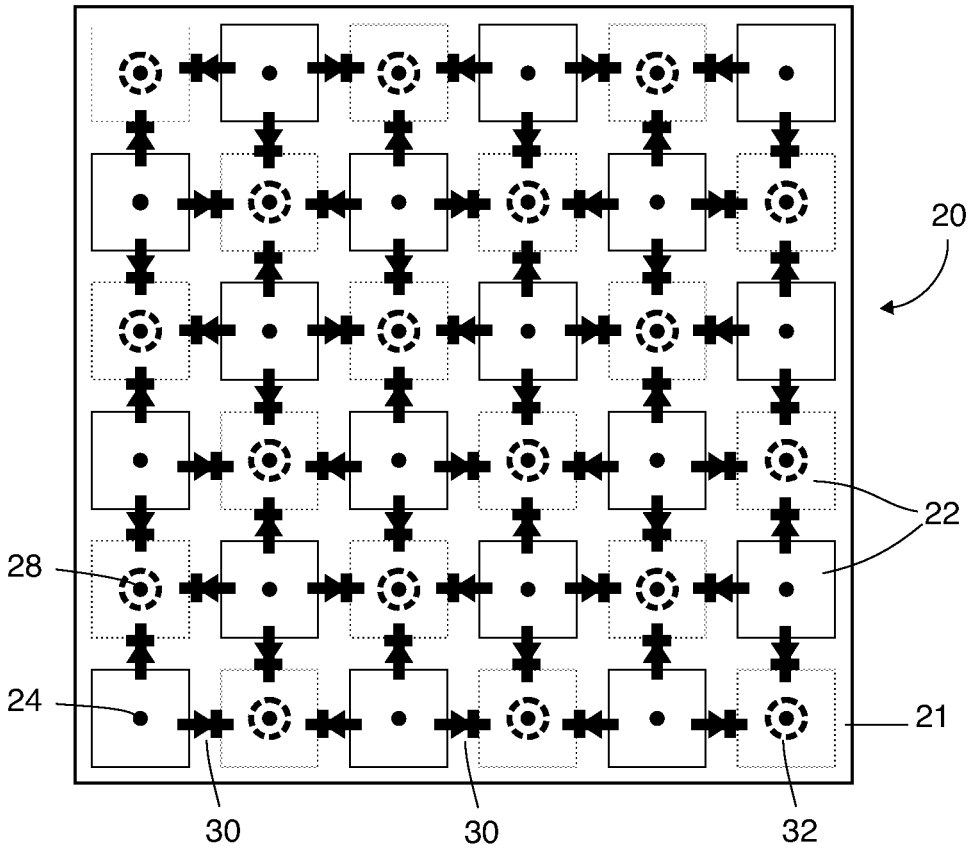
prior art Fig. 2a
FIG. 2*a* is a top view of a prior art selective frequency surface with variable capacitors in the form of varactors, added to tunably control the impedance of the surface.
Figure 2B:
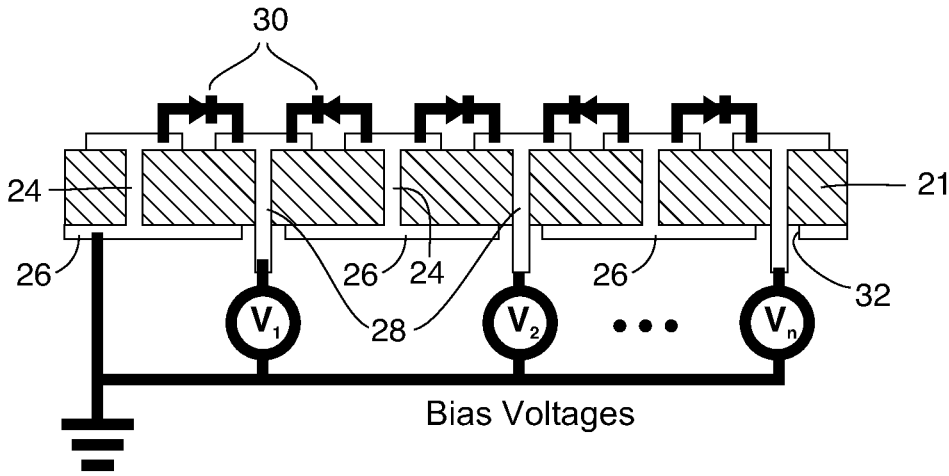
Fig. 2b prior art
FIG. 2*b* is a side elevational view of the surface if FIG. 2*a;*
Figure 3A:
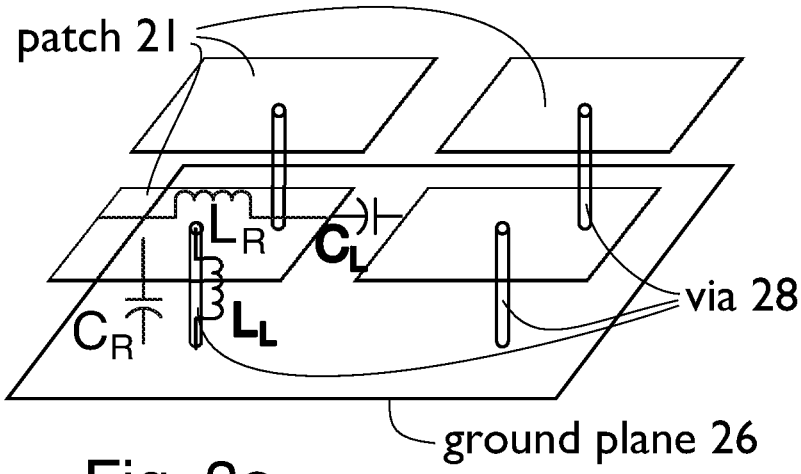
FIG. 3*a* depicts in a model similar to that of FIG. 1*a*, but showing the effect of introducing the bias network for controlling the varactors of FIGS. 2*a* and 2*b;*
Figure 3B:
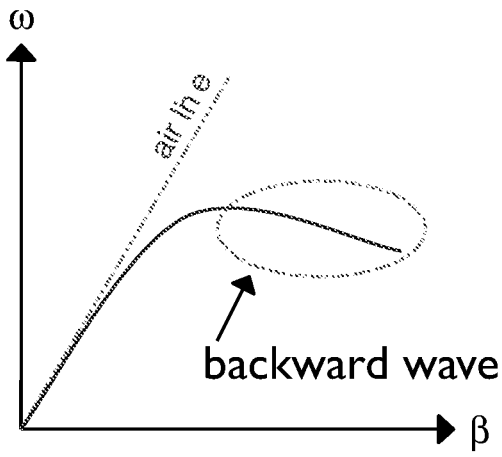
FIG. 3*b* is a graph of frequency vs. propagation constant for the surface of FIG. 3*a;*
Figure 5:
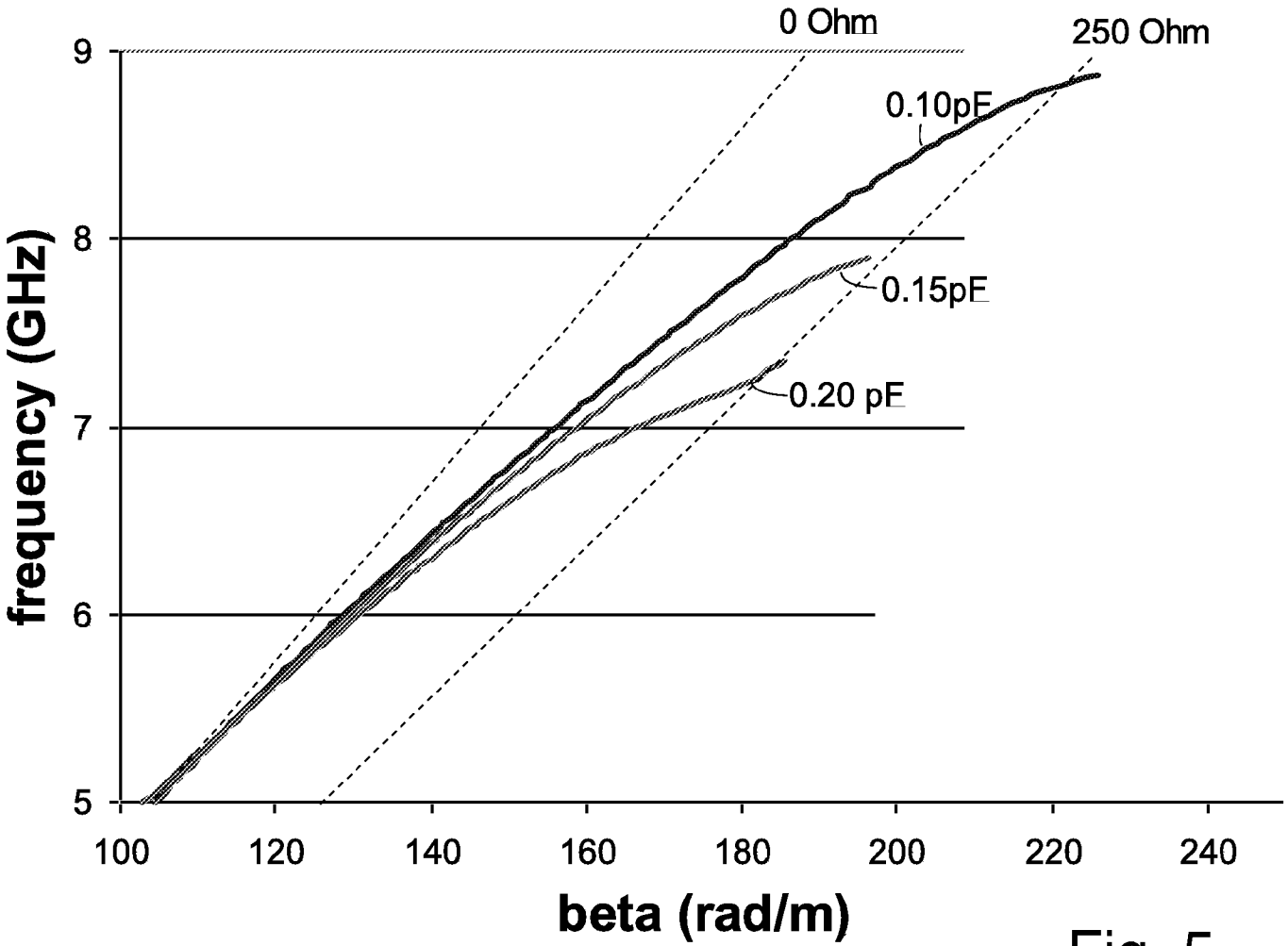
FIG. 5 is a graph of the numerical dispersion diagram of tunable surface wave impedance structure based on conventional biasing network as shown in FIGS. 2*a* and 2*b*.

Numerical simulations were performed on a surface wave structure with a prior art biasing scheme as illustrated in FIGS. 2*a* and 2*b* and with the biasing scheme described herein and depicted in FIGS. 4*a* and 4*b*. Dispersion diagrams were obtained and are shown in FIG. 5 for the case of FIGS. 2 and 2*b* and in FIG. 6 for the case of FIGS. 4*a* and 4*b*. The conductive patch/element 22 and dielectric layer 21-1 details were the same for both cases.

FIG. 5 is a graph of the numerical dispersion diagram of tunable surface wave impedance structure based on conventional biasing network as shown in FIGS. 2*a* and 2*b*. FIG. 5 shows that by changing the varactor diode's capacitance (a range of 0.1 pF to 0.2 pF is shown), the surface impedance can be varied at fixed frequencies. However, the surface impedance range is limited to j250 Ohms after which a backward wave mode appears, which the source propagating wave cannot couple to. So after j250 Ohms, the mode appears to be cut-off due to the onset of backward wave propagation.

Figure 6:
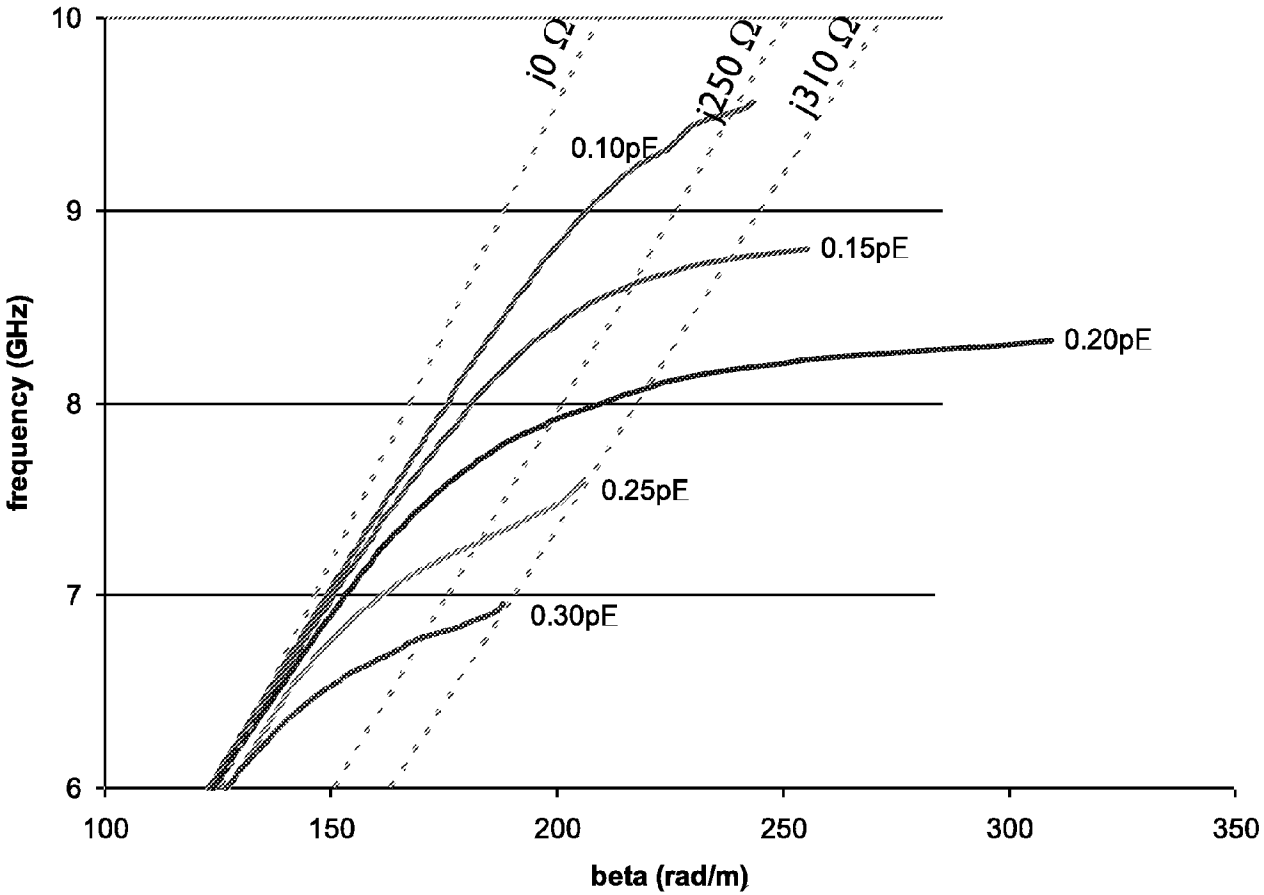
FIG. 6 is a graph of the numerical dispersion diagram of tunable surface wave impedance structure based on biasing network as shown in FIGS. 4*a* and 4*b*. Surface wave impedance goes beyond j250 Ohm and is extended out to j310 Ohm and higher. Patch size and the dielectric layer between patch/RF ground are the same as used to generate FIG. 5.

FIG. 6 is a graph of the numerical dispersion diagram of tunable surface wave impedance structure based on biasing network as shown in FIGS. 4*a* and 4*b*. Surface wave impedance goes beyond j250Ω and is extended out to j310Ω and higher. Patch size and the dielectric layer between patches 22 and the RF ground 26 are the same as used to generate FIG. 5. In the case of the present invention, surface impedance tuning is also possible by changing the varactor diode's capacitance (a range of 0.1 pF to 0.3 pF is shown in FIG. 6) and the surface impedance range is increased; the surface impedance range is extended to j310Ω and above.

MEMS capacitors and optically controlled varactors may be used in lieu of the voltage controlled capacitors (varactors) discussed above. If such optically controlled varactors need to be supplied with a bias voltage, then the conductive vias 24 and 28 discussed above are still needed, but a common bias voltage may be substituted for the bias voltages V1, V2, . . . Vn discussed above as the optically controlled varactors would be controlled, in terms of varying their capacitance, by optical fibers preferably routed through penetrations in substrate 21 located, for example, directly under the varactors 30 shown in FIG. 4*a*.

It should be understood that the above-described embodiments are merely some possible examples of implementations of the presently disclosed technology, set forth for a clearer understanding of the principles of this disclosure. Many variations and modifications may be made to the above-described embodiments of the invention without departing substantially from the principles of the invention. All such modifications and variations are intended to be included herein within the scope of this disclosure and the present invention and protected by the following claims.

What is claimed is:

1. A method of delaying the onset of a backward wave mode in a frequency selective surface having a two dimensional array of conductive patches and an RF ground plane, the two dimensional array of patches being interconnected by variable capacitors, the method comprising separating grounds associated with the variable capacitors from the RF ground plane and providing a separate conductive mesh structure as a ground for said variable capacitors.

2. The method of claim 1 wherein the separate conductive mesh structure is spaced from one side of said RF ground plane and wherein the two dimensional array of conductive patches is spaced from another side of said RF ground plane.

3. The method of claim 2 wherein the patches each have a control line which is either coupled to said separate conductive mesh structure or which is connected to a biasing network supplying biasing voltages $V_1, V_2, \ldots V_n$ to an associated control line.

4. The method of claim 1 wherein the variable capacitors are varactors.

5. A tunable impedance surface comprising:

(a) a RF ground plane;

(b) a plurality of elements disposed in an array a distance from the ground plane;

(c) a capacitor arrangement for controllably varying capacitance between at least selected ones of the elements in said array; and (d) a grounding mesh associated with said capacitor arrangement for providing a bias voltage ground to capacitors in said capacitor arrangement, the grounding mesh being spaced from the RF ground plane by dielectric material.

6. The tunable impedance surface of claim 5 further including a substrate having at least first and second layers, said first layer being a first dielectric layer facing said ground plane on a first major surface thereof and facing said plurality of elements on a second major surface thereof and said second layer being a second dielectric layer and providing said dielectric material.

7. The tunable impedance surface of claim 6 wherein said capacitor arrangement is adjustable to tune the impedance of said surface spatially.

8. The tunable impedance surface of claim 5 wherein the RF ground plane has an array of openings formed herein for passing a connection from each of the plurality of elements to a selected one of either the grounding mesh or to a selected bias voltage.

9. A method of tuning a high impedance surface for reflecting a radio frequency signal comprising:

arranging a plurality of generally spaced-apart conductive surfaces in an array disposed essentially parallel to and spaced from a conductive RF ground plane, and varying the capacitance between at least selected ones of adjacent conductive surfaces in to thereby tune the impedance of said high impedance surface using bias voltages, the bias voltages being referenced to a bias voltage ground supplied via a grounding mesh which is isolated from said RF ground plane by a layer of dielectric material.

10. The method of claim 9 wherein said plurality of generally spaced-apart conductive surfaces are arranged on a multi-layered printed circuit board, said layer of dielectric forming at least one layer of said multi-layered printed circuit board.

11. The method of claim 9 wherein the step varying the capacitance between adjacent conductive surfaces in said array includes connecting variable capacitors between said at least selected ones of adjacent conductive surfaces.

12. The method of claim 9 wherein the capacitance is varied between all adjacent elements.

13. The method of claim 9 wherein the step of varying the capacitance between at least selected ones of adjacent conductive surfaces includes applying said bias voltages to selected ones of said conductive surfaces and applying said bias voltage ground to other ones of said conductive surfaces.

14. The method of claim 9 wherein spacing of each conductive surface from the RF ground plane is less than a wavelength of a radio frequency signal impinging said surface, and preferably less than one tenth of a wavelength of a radio frequency signal impinging said surface.

15. A tunable impedance surface for reflecting a radio frequency beam, the tunable surface comprising:

(a) a ground plane;

(b) a plurality of elements disposed in an array a distance from the ground plane, the distance being less than a wavelength of the radio frequency beam;

(c) a capacitor arrangement for controllably varying the impedance along said array; and (d) means for suppressing a formation of a backward wave by said tunable impedance surface.

16. A tunable impedance surface comprising: (a) a ground plane; (b) a plurality of discreet elements disposed in a two-dimensional array a distance from the ground plane; and (c) a plurality of capacitors coupling neighboring ones of said elements in said two dimensional array for controllably varying capacitive coupling between said neighboring ones of said elements in said two-dimensional array while at the same time suppressing a formation of a backward wave by said tunable impedance surface.

17. The reflecting surface of claim 16, wherein the plurality of capacitors is provided by a plurality of variable capacitors coupled to said neighboring ones of said elements in said two-dimensional array.

* * * * *